US006432026B1

(12) United States Patent
Wang et al.

(10) Patent No.: US 6,432,026 B1
(45) Date of Patent: Aug. 13, 2002

(54) HEIGHT-ADJUSTABLE MECHANISM FOR A RUNNING FRAME OF A TREADMILL

(76) Inventors: Leao Wang; Peter Wu, both of No. 1, Lane 233, Sec. 2, Charng Long Rd., Taiping 411 (TW)

( * ) Notice: Subject to any disclaimer, the term of this patent is extended or adjusted under 35 U.S.C. 154(b) by 1 day.

(21) Appl. No.: 09/621,380

(22) Filed: Jul. 21, 2000

(51) Int. Cl.[7] ..... A63B 22/02
(52) U.S. Cl. ..... 482/54
(58) Field of Search ..... 482/54, 51

(56) References Cited

U.S. PATENT DOCUMENTS 5,352,167 A * 10/1994 Ulicny ..... 482/54
5,372,559 A * 12/1994 Dalebout et al. ..... 482/54
5,378,212 A * 1/1995 Pin-Kuo ..... 482/54
6,254,515 B1 * 7/2001 Carman et al. ..... 482/54

* cited by examiner

*Primary Examiner*—Stephen R. Crow
(74) *Attorney, Agent, or Firm*—Troxell Law Office PLLC; Kuo-Hsiung Chiu

(57) ABSTRACT

A height-adjustable mechanism for a running frame of a treadmill in which a motor is provided at the bottom of the running frame in order to drive a worm shaft which drives a gearbox having a polygonal output shaft protruding from two sides of the gearbox driving supporting rods with rolling wheels to perform a height-adjusting action for the running frame.

1 Claim, 3 Drawing Sheets

HEIGHT-ADJUSTABLE MECHANISM FOR A RUNNING FRAME OF A TREADMILL

BACKGROUND OF THE INVENTION

1. Field of the Invention

The present invention relates to a height-adjustable mechanism for a running frame of a treadmill, and more particularly to such a mechanism having a gearbox and an output shaft at two sides driving a supporting rod for adjusting the height of the running frame.

2. Description of the Prior Art

A treadmill, as shown in FIG. 1, is an excellent exercise apparatus for the user to make a jogging exercise. Simply speaking, it is operated by a main motor (not shown) driving a belt (not shown) when then drives front and rear roller units so that a running belt 12 disposed around the roller units rotates. Therefore, the user can jog on the running belt in accordance with the rotation speed of the running belt 12.

In order to increase the exercise fun of the treadmill, most treadmills are fitted with a height-adjustable mechanism for adjusting the angle of elevation of the running frame 14 to different slopes. As for the height-adjusting mechanism produced by current manufacturers, it is either manually or electrically operated. The manual mechanism is inconvenient while the electric one is complicated in configuration, and therefore impractical.

SUMMARY OF THE INVENTION

It is a primary object of the present invention to provide a height-adjustable mechanism for a running frame of a treadmill which can enhance the using and operating convenience while decreasing the maintenance of the treadmill.

BRIEF DESCRIPTION OF DRAWINGS

The accomplishment of this and other objects of the invention will become apparent from the following description and its accompanying drawings of which.

DETAILED DESCRIPTION OF THE PREFERRED EMBODIMENT

Figure 1:
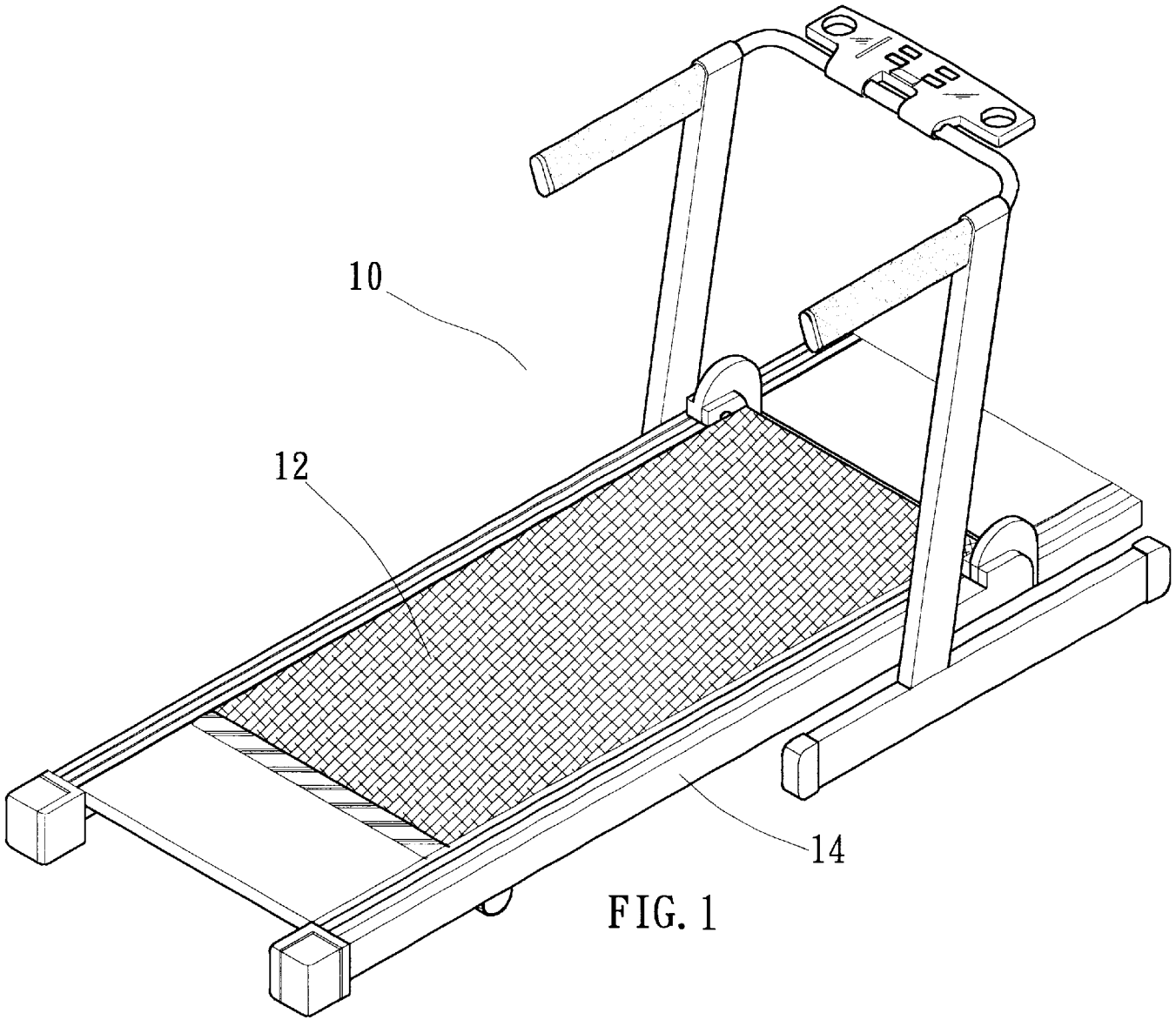
FIG. 1 is a perspective view of an electric treadmill.
Figure 2:
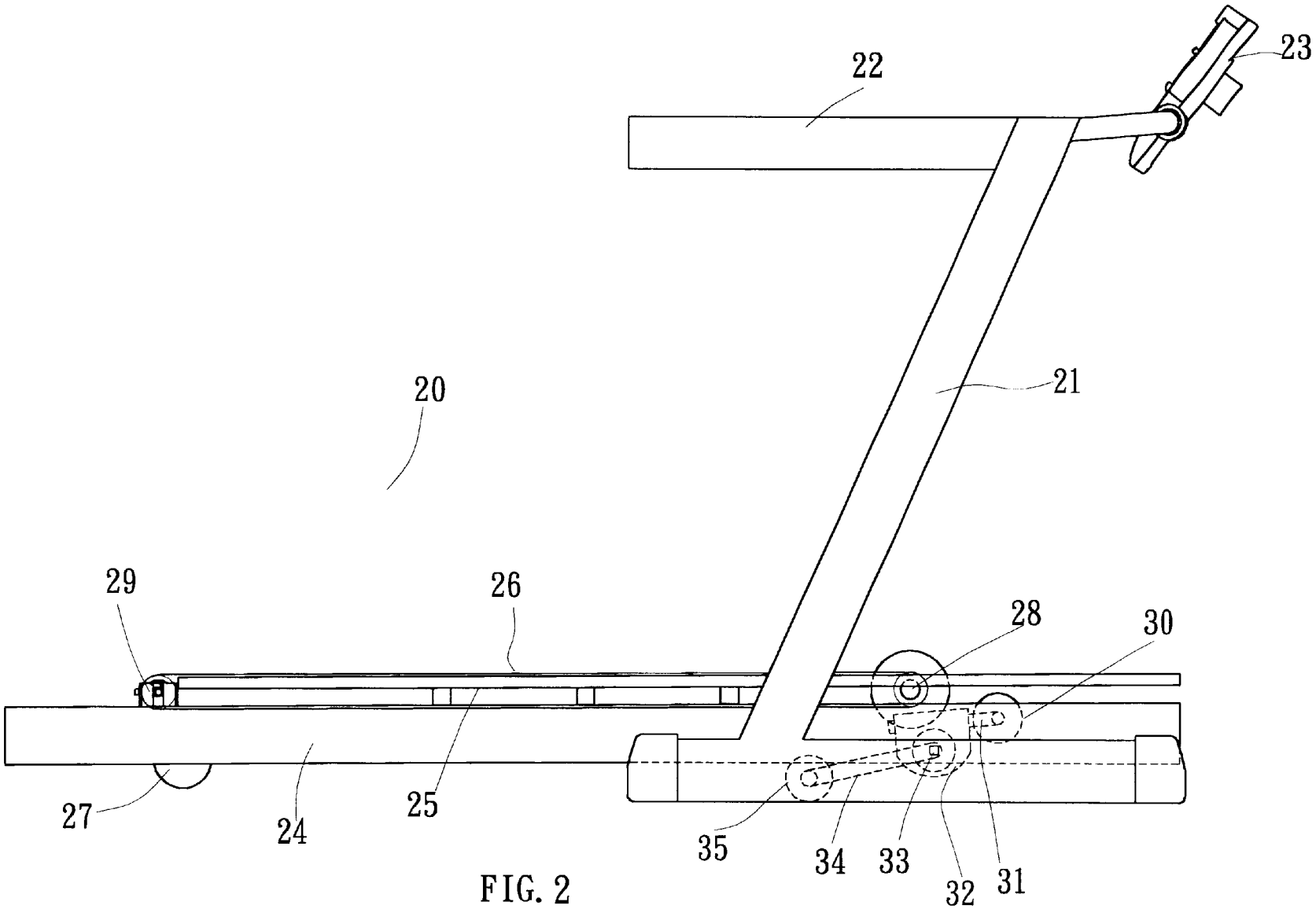
FIG. 2 is a side view of a preferred embodiment of the present invention.
Figure 3:
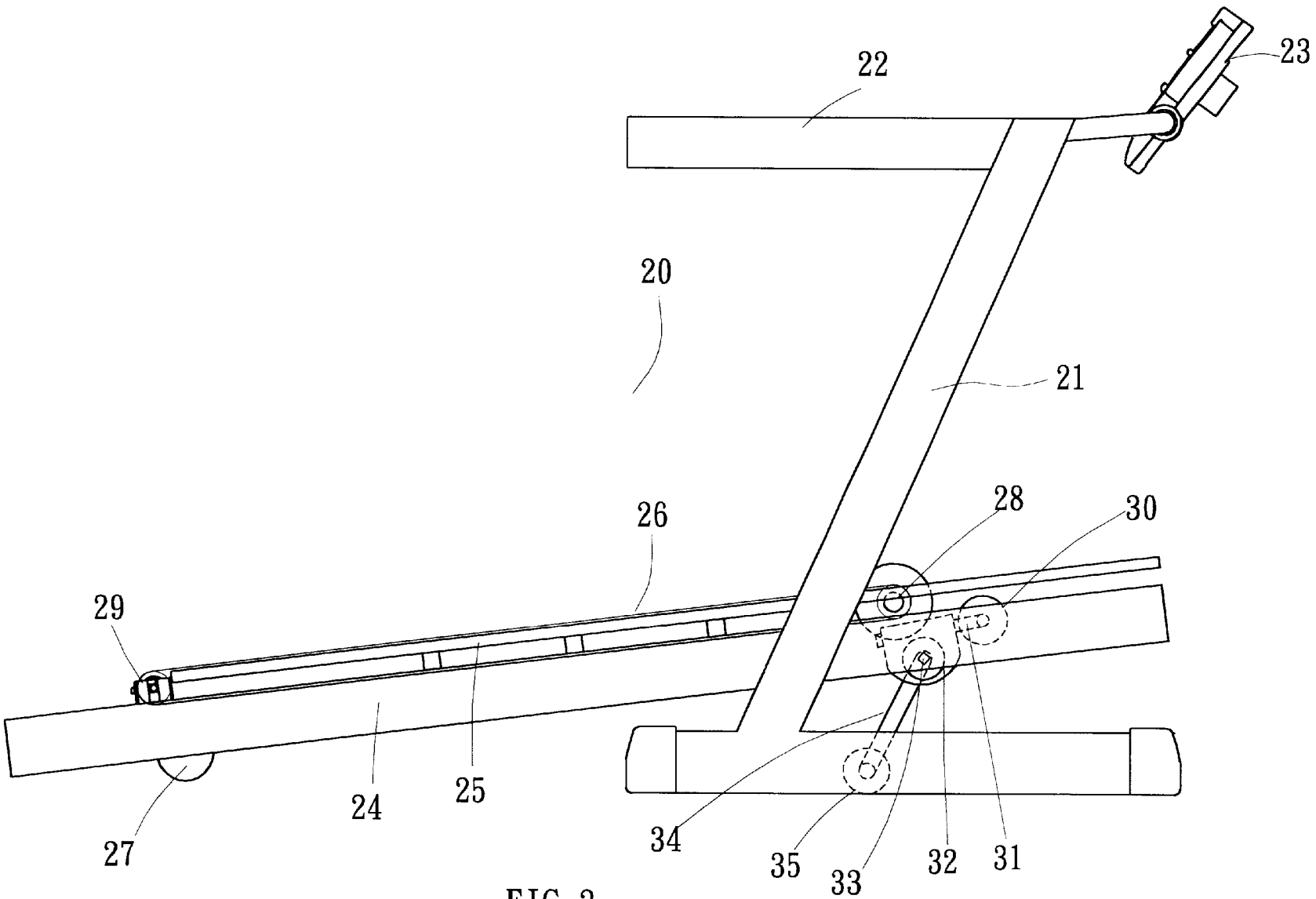
FIG. 3 is a side view of a running board of the present invention adjusted in height.

First of all, referring to FIGS. 2 and 3, the exercise treadmill 20 in accordance with the present invention primarily includes a treadmill frame 21, a hand rest 22, an electric control panel 23, a main motor (not shown), a running frame 24, a running board 25, a running belt 26 and a supporting rear wheel 27. The main motor drives a front roller 28. Moreover, the endless running belt 26 circles around the front and rear rollers 28, 29 and is driven by means of the rotation of the main motor.

The present invention is characterized in that a motor 30 is provided at the bottom of the running frame 24 in order to rotate a worm shaft 31 which drives a gearbox 32 in order for a polygonal output shaft 33 protruding from two sides of the gearbox 32 to rotate from the original position. A supporting rod 34 with a rolling wheel 35 is driven to perform a height-adjusting action of the running frame 24, as shown in FIG. 3.

In brief, when the worm shaft 31 is driven by the motor 30 to rotate from the original position, the gearbox 32 is also operated. The position of the gearbox 32 is unchanged and the torsion will be transmitted by the output shaft 33 at two sides thereof so that the supporting rod 34 will be synchronously turned by the output shaft 33 in the expected direction. Accordingly, the angle of elevation of the supporting running frame 24 is changed and adjusted.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. A height adjusting mechanism for a treadmill having a treadmill frame including a hand rest, and a running frame having a driven endless running belt thereon, the adjusting mechanism comprising:

a) a motor mounted on the running frame and a rotating worm shaft extending exteriorly of the motor, b) a gearbox located on the running frame, the gearbox having a polygonal output shaft extending from two sides of the gearbox, the gearbox driven by the worm shaft of the motor; and, c) a supporting rod directly connected solely to each polygonal output shaft so as to move with the associated polygonal output shaft, each supporting rod having a rolling wheel on a distal end thereof, whereby rotation of the polygonal output shafts moves the supporting rods to thereby adjust a height of the running frame.

* * * * *